United States Patent [19]

Menser

[11] 4,411,216

[45] Oct. 25, 1983

[54] PRESSURE SATURATOR

[75] Inventor: Howard K. Menser, Plymouth, Ind.

[73] Assignee: Miply Equipment Inc., South Bend, Ind.

[21] Appl. No.: 320,317

[22] Filed: Nov. 12, 1981

[51] Int. Cl.[3] ..... B05C 3/12

[52] U.S. Cl. ..... 118/117; 118/419; 118/429

[58] Field of Search ..... 118/117, 109, 106, 429, 118/427, 419; 156/189; 427/439; 68/15, 158

[56] References Cited

U.S. PATENT DOCUMENTS

| | | | |
|---|---|---|---|
| 2,721,144 | 10/1955 | Penley | 118/419 X |
| 3,454,419 | 7/1969 | Smith et al. . | |
| 3,493,401 | 2/1970 | Schutt et al. . | |
| 3,616,194 | 11/1971 | Russell . | |
| 3,826,703 | 7/1974 | Russell . | |
| 4,152,908 | 5/1978 | Bertoldi | 68/158 |

*Primary Examiner*—Norman Morgenstern
*Assistant Examiner*—Mary Beth Calligaris
*Attorney, Agent, or Firm*—Marmaduke A. Hobbs

[57] ABSTRACT

A pressure saturator for impregnating porous substrate materials with solids in solution, in which a reservoir contains the saturant solution and has a base member with a portion forming a depression therein. A mandrel is disposed within the depression in spaced relation to the surface of the depression. Preferably, the distance between the surface of the depression and the mandrel is three times the thickness of the substrate material. Heating elements are disposed in the base and heat the portion of the base member forming the depression, thereby heating the solution between the mandrel and the surface of the depression. The substrate is fed into the saturator from a supply roll and is passed through the space between the depression and the mandrel. The heated solution causes solids from the solution to replace the air in the interstices of the substrate in a near 100 percent weight-to-weight saturation. The area of the reservoir above the depression and mandrel may be cooled to provide a more effective exchange within the substrate.

13 Claims, 2 Drawing Figures

PRESSURE SATURATOR

Figure 1:
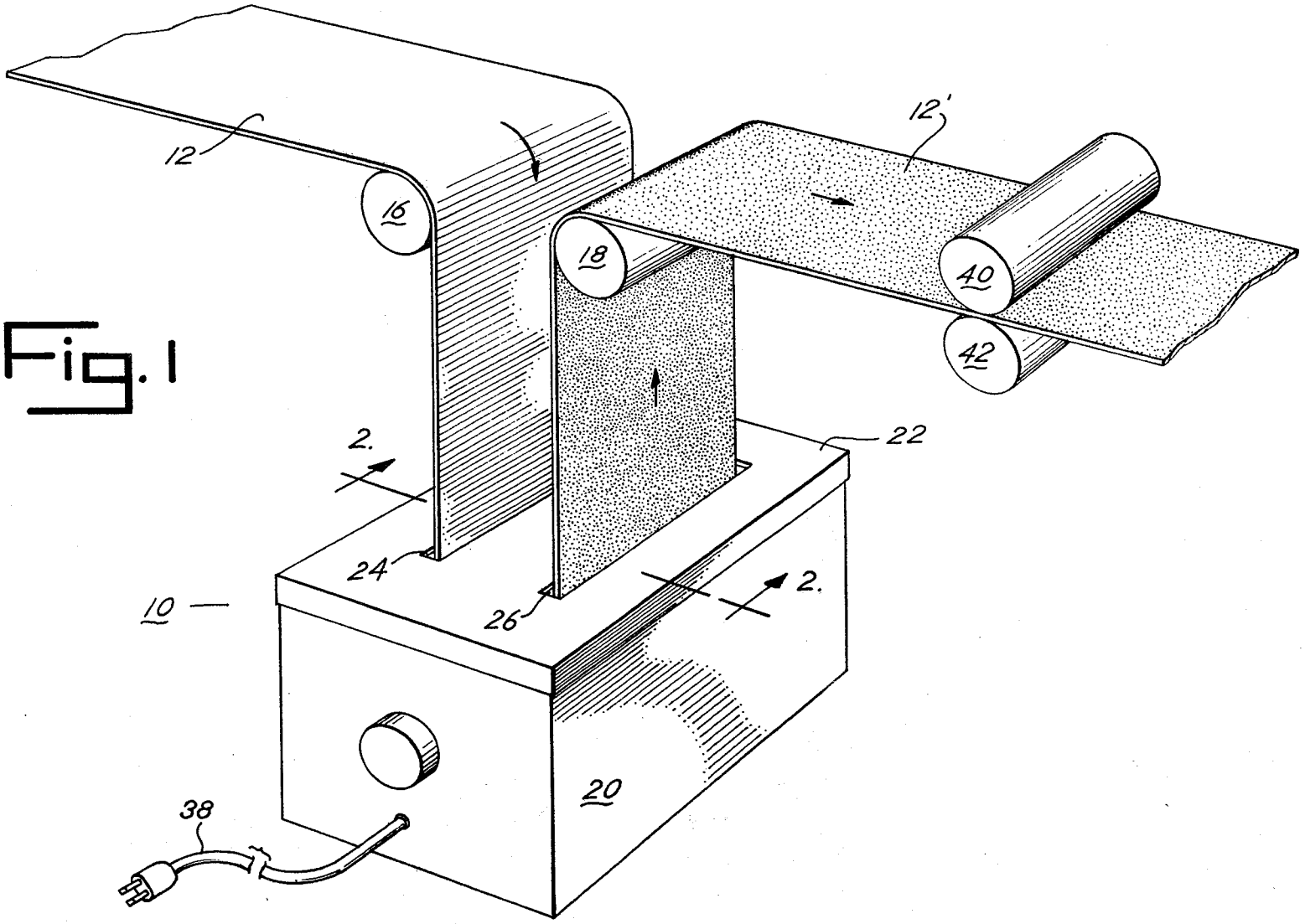

Products made from porous, fibrous materials impregnated with solids have widespread utility in many industries. For example, if paper is impregnated with alkali metal silicates, the paper becomes increasingly rigid and hard as the silicate concentration within the paper is increased. The saturation process may also be used to increase the water and fire resistance above that of the unimpregnated substrate. Paper material impregnated with silicates is used extensively in construction, packaging and other industries. The impregnated paper is often used for reinforced boxes and other containers as well as for sheeting, wrapping and the like. Several layers of the silicate impregnated substrate may be bonded together to form wall paneling, counter tops and other construction materials. Whether the impregnated paper products are used in single layers or in a plurality of bonded layers, they can often replace more expensive materials such as plastic or metal.

Previous methods for saturating or impregnating paper were only partially satisfactory, in that a maximum of only about 35 percent weight-to-weight saturation of the substrate material with silicate was achieved. Since only materials having low saturation concentrations of silicate were available, it was necessary to bond together several layers of the impregnated substrate whenever a substantially hard or rigid end product was being produced. It was not possible to produce substantially hard and rigid products from one substrate layer; therefore, substantially hard products which were also relatively thin were not available using previous saturation techniques. In some uses it is desirable to have a relatively rigid material which is also relatively thin. By increasing the weight-to-weight silicate concentration in the substrate a more rigid product is achieved. Hence, a paper product saturated to a near 100 percent weight-to-weight ratio of saturant solid to substrate weight would be substantially more rigid than a product of 35 percent saturation. Also, the cost of production is reduced if only one layer of substrate is required, since the bonding step can be eliminated. The previous impregnating processes have been slow and have required several passes of the substrate through the saturant solution to achieve higher concentration levels of the solid in the substrate. Hence, a saturator which can achieve a near 100 percent weight-to-weight concentration of saturant solid in the substrate, during one rapid transfer, will substantially reduce production cost and time. The previous saturation methods also have been energy inefficient, in that they require the use of substantial amounts of energy, first to steam impregnate the substrate to force the air therefrom, and second to heat the reservoir of saturant solution. Normally, in previous saturators, the entire reservoir holding the saturant solution is heated, requiring large amounts of energy and substantially increasing the expense of producing saturated products.

It is therefore one of the principal objects of the present invention to provide a pressure saturator which can achieve a near 100 percent weight-to-weight saturation of a fibrous substrate material with a solid saturant in solution, and which can achieve the near 100 percent weight-to-weight saturation during one pass of the substrate through the saturant solution, requiring a minimal amount of time.

Another object of the present invention is to provide a pressure saturator which can impregnate a continuous length of substrate fed into the saturator from a supply roll, and which can impregnate the continuous substrate quickly and continuously, thereby substantially reducing manufacturing costs involved in the saturation process.

A further object of the present invention is to provide a pressure saturator which eliminates the steam saturation step used in previous saturators by driving off the air retained in the interstices of the fibrous substrate and impregnating the substrate with the saturant solid in one step, and which can be used to impregnate the substrate with a variety of different saturant solids.

A still further object of the present invention is to provide a pressure saturator which is energy efficient and requires a minimal amount of energy to heat the substrate, and which eliminates the need to heat the entire reservoir of saturant solution.

Still another object of the present invention is to provide a pressure saturator which eliminates the need for a high pressure containment vessel by using the unheated solution in an unpressurized reservoir as the pressure cap over the heated solution, and which has an adjustable device for reducing the saturation of the substrate below the 100 percent weight-to-weight concentration.

Figure 2:
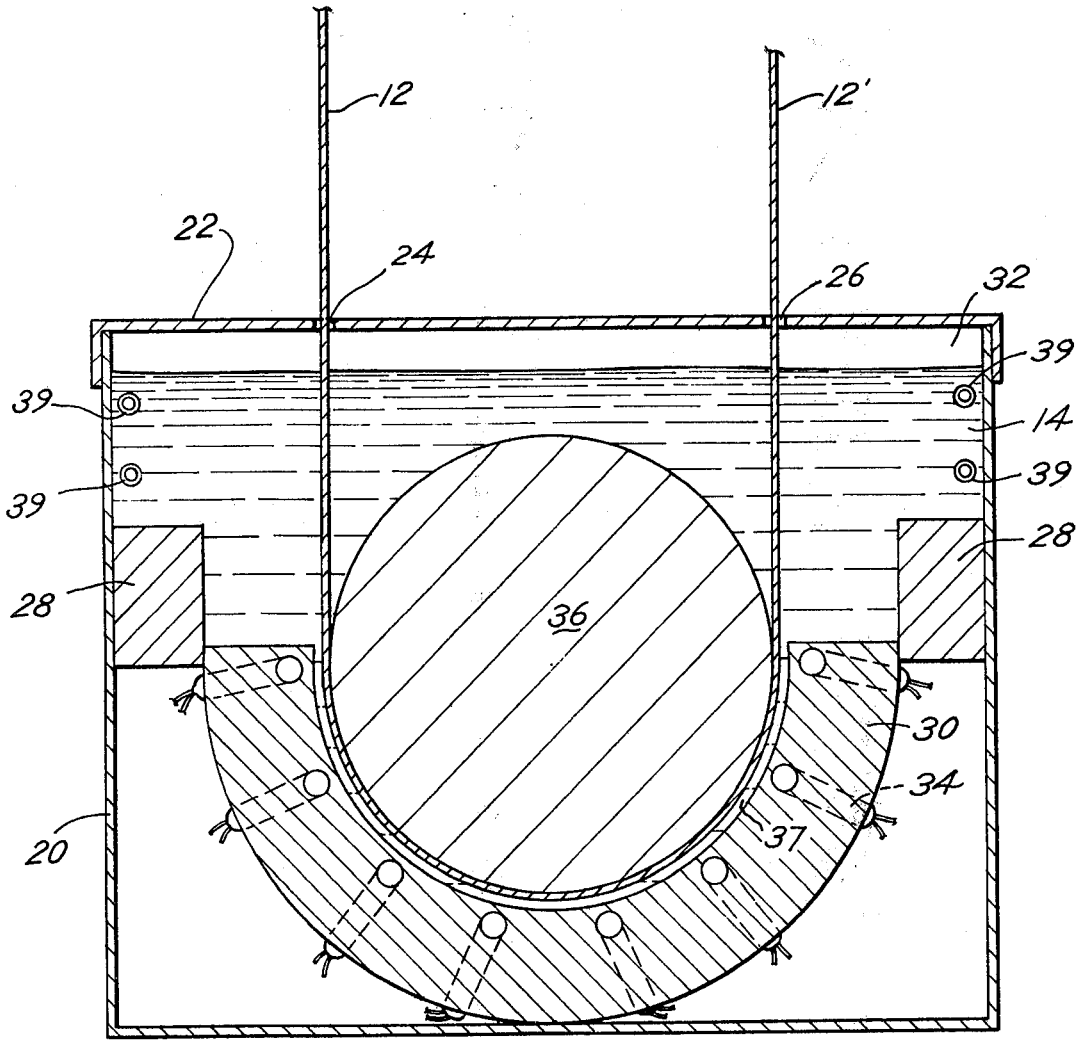

Additional objects and advantages of the present invention will become apparent from the following detailed description and the accompanying drawings, wherein:

FIG. 1 is a perspective view of a pressure saturator embodying the present invention; and FIG. 2 is a vertical cross sectional view of the pressure saturator shown in FIG. 1, taken on line 2—2 of the latter figure.

Referring more specifically to the drawings, and to FIG. 1 in particular, numeral 10 designates a pressure saturator embodying the present invention. The present saturator can be used to impregnate most common porous substrate materials 12 with a variety of solid saturating elements contained in an appropriate saturating solution 14. The well-known solutions of the sodium silicate $Na_2O$: 3.22 $SiO_2$ used in previous saturators work well in the present saturator; however, other solids in solution work equally well.

Substrate 12 is fed into saturator 10 in a continuous sheet from a supply roll, not shown. As previously mentioned, the present saturator works well with any fibrous, porous substrate material. One well-known and commonly used substrate for previous saturating techniques is Kraft paper, which is also suitable for use in the present saturator. After having passed through the saturator, the saturated substrate 12' will normally be passed through appropriate gas or electric drying mechanisms, which do not constitute a part of the present invention and are not shown. The drying mechanisms remove sufficient moisture from the substrate so that it may be stored in a roll without the adjacent layers adhering to each other. Rollers 16 and 18 are used to properly position the substrate material for passing into and out of saturator 10.

Saturator 10 has a housing 20 with a cover 22 thereon, slots 24 and 26 in cover 22 permitting the substrate material to pass therethrough. The length of saturator 10 and of slots 24 and 26 may vary, depending upon the width of substrate 12. A flange 28 is disposed within housing 20 and has attached thereto a semitubular base member 30, flange 28 and member 30 forming the bottom of a solution reservoir 32 which is filled with saturant solution 14. A plurality of heating elements 34 are disposed within member 30 to heat the solution thereabove. A mandrel 36, of a diameter smaller than the diameter of member 30, is disposed within the depression 37 formed by the semitubular member in the bottom of the reservoir. Mandrel 36 is centrally disposed within the depression 37 in reservoir 32 so that a uniform distance exists between the mandrel and member 30. For the most efficient operation of the saturator, the distance between mandrel 36 and member 30 should be approximately three times the thickness of the substrate to be impregnated. The heating elements 34 are connected by an electric cord 38 to an electrical power source.

In the use and operation of a pressure saturator embodying the present invention, reservoir 32 is filled with the appropriate saturating solution 14 to a level substantially above flange 28 and preferably above mandrel 36. The heating elements 34 are connected to a power source and heat member 30. Thus, the saturant solution between member 30 and mandrel 36 is heated to an appropriate temperature, usually between 100° F. and 600° F. The temperature to which the solution is heated will vary, depending upon the saturant being used. Since only the small amount of solution between member 30 and mandrel 36 must be heated, the energy required to operate the present saturator is substantially less than the energy required to operate previous saturators which heated the entire solution reservoir. An additional advantage resulting from the heating of only the thick layer of solution is that the start up time for the present saturator is relatively short. Sufficient operating temperatures are reached quickly and are easily maintained during the saturation process.

When the solution has been heated to the appropriate saturating temperature, the substrate material 12 is passed through solution 14 and around mandrel 36. As the substrate passes through the heated solution, the air in the interstices of the fibrous substrate is driven therefrom and is replaced by the solids in saturant solution 14. The large volume of unheated saturant solution above the thin layer of heated solution provides a pressure cap over the heated area, hence creating a pressure vessel between mandrel 36 and member 30. As the layer of solution between member 30 and mandrel 36 is heated, it expands and increases in pressure. The heated and pressurized solution between the member and the mandrel readily drives the air out of the substrate and fills the interstices with the solids in the solution. The air driven out of substrate 12 by the expanding heated solution, and replaced by the solids in the solution, exhausts from the saturator by bubbling upwardly through solution 14. The substrate material 12 can be passed through the solution in a continuous sheet supplied from a mill roll and can be received on a take up roll after passing from the dryers. Since the solution between mandrel 36 and member 30 is heated by elements 34 and pressurized because of the liquid cap thereabove, a near 100 percent weight-to-weight concentration of the saturant solids in the substrate results nearly instantaneously during only one pass through the saturator. The impregnating process can be made more efficient for some saturant solutions if the reservoir area above member 30 is cooled. A plurality of cooling tubes 39 or other suitable means for cooling the solution in the upper reservoir area may be used. The substrate 12 can then be passed more rapidly through the saturator as a more rapid 100 percent weight-to-weight transfer occurs.

Since nearly 100 percent concentration of the solid in the substrate is accomplished in an almost instantaneous transfer by the present saturator, when less than 100 percent concentrations are desired in the final product, pinch rollers 40 and 42 are provided, and the saturated, yet undried, substrate 12' is passed therebetween, with the rollers performing a wringing or squeezing function to remove some of the saturant from the substrate. By proper adjustment of pinch rollers 40 and 42, the desired level of saturation can be achieved.

It is clear that the present saturator, which achieves nearly instantaneous 100 percent weight-to-weight concentration of the saturant solid in the substrate material during only one pass of the substrate through the solution, requires far less energy than previous methods which required several passes. Elements 34 need only heat that solution which is between member 30 and mandrel 36. Since normally this layer of solution will be only three times the thickness of the substrate being impregnated, it is relatively easy to heat and maintain this solution layer at the required temperature. Most of solution 14 in reservoir 32 is not heated; hence, substantial energy savings are realized over the previous saturators which heated all of the solution within the reservoir. Since a more firm and rigid end product is achieved when 100 percent weight-to-weight concentrations are achieved, fewer layers of substrate impregnated by the present saturator are required than were previously required to make a product such as wall paneling, counter tops and the like for which a specific rigidity is needed. Products having the same rigidity as those made from substrate impregnated by previous saturating techniques require fewer layers of 100 percent saturated substrate. Hence, equally rigid yet thinner products are possible by using substrate impregnated by the present saturator than by using substrate from previous saturators.

The pressure transfer of the solids in solution into the interstices of the substrate can be performed without heating the solution. The solution in the transfer area may be pressurized hydraulically, and the substrate passed therethrough. The pressurized solution will force the air from the substrate and the solids in the solution will fill the spaces from which the air was driven. This modified form of saturator is particularly advantageous when it is undesirable to heat either the saturant solution, the substrate material or both.

Although one embodiment and several modifications of the present pressure saturator have been described in detail herein, various other changes can be made without departing from the scope of the present invention.

I claim:

1. A pressure saturator for impregnating a porous substrate with a solid from a saturant solution, comprising a housing forming a reservoir for holding the saturant solution, a base member having an arcuate inner wall forming a depression in the bottom of said reservoir, a mandrel disposed in said reservoir with a portion thereof extending into said depression for guiding the substrate through the saturant solution, the perimeter of said portion of said mandrel being spaced from and in close proximity to said arcuate inner wall of said base member and, in combination with said inner wall, defining an unobstructed chamber the radial width of which is sufficiently narrow to produce by hydraulic action an increase in pressure of the solution therein as the substrate passes therethrough, and heating element means disposed in said base member for heating the saturant solution in said depression.

2. A pressure saturator as defined in claim 1 in which said radial width is approximately three times the thickness of the substrate.

3. A pressure saturator as defined in claim 2 in which pinch rollers are provided for wringing saturant from the substrate material to achieve lower than 100 percent weight-to-weight concentrations of the saturant solid in the substrate.

4. A pressure saturator as defined in claim 3 in which a cover is disposed over said reservoir and slots are disposed therein through which said substrate passes.

5. A pressure saturator as defined in claim 4 in which conduit means is disposed in said housing above said base member for cooling the saturant solution in said reservoir above said base member.

6. A pressure saturator as defined in claim 1 in which pinch rollers are provided for wringing saturant from the substrate material to achieve lower than 100 percent weight-to-weight concentrations of the saturant solid in the substrate.

7. A pressure saturator as defined in claim 1 in which conduit means is disposed in said housing above said base member for cooling the saturant solution in said reservoir above said base member.

8. In combination, a porous fibrous substrate material, a saturant solution and a pressure saturator for replacing the air in the interstices of the substrate material with solids from the saturant solution, a housing forming a reservoir with an arcuate inner wall for holding the saturant solution, a guide member disposed in said reservoir around which the substrate is passed, the periphery of said guide member being spaced from and in close proximity to said arcuate inner wall and, in combination with said inner wall, defining an unobstructed chamber the radial width of which is sufficiently narrow to produce by hydraulic action an increase in pressure of the solution therein as the substrate material passes therethrough, a means including the weight of the solution in said housing for further pressurizing the solution between the inner wall of said reservoir and said guide member, and element means included in said housing for heating the solution in said chamber.

9. A pressure saturator as defined in claim 8 in which a portion of said reservoir is of semi-tubular shape and forms a depression in said base, and said guide member is a mandrel disposed within said reservoir in spaced relation to the side and bottom walls thereof.

10. A pressure saturator as defined in claim 9 in which said radial width is approximately three times the thickness of the substrate.

11. A pressure saturator as defined in claim 8 in which said radial width is approximately three times the thickness of the substrate.

12. A pressure saturator as defined in claim 8 in which the housing forming the reservoir has a means including a conduit in said housing for maintaining the solution above said chamber relatively cool with respect to the solution in said chamber.

13. A pressure saturator for impregnating a porous substrate with a solid from a saturant solution, comprising a housing forming a reservoir for holding the saturant solution, a base member having an arcuate inner wall forming a depression in the bottom of said reservoir, a mandrel disposed in said reservoir with a portion thereof extending into said depression for guiding the substrate through the saturant solution, the periphery of said portion of said mandrel being spaced from and in close proximity to said arcuate inner wall of said base member and, in combination with said inner wall, defining an unobstructed chamber the radial width of which is sufficiently narrow to produce by hydraulic action an increase in pressure of the solution therein as the substrate passes therethrough, and conduit means being disposed in said housing above said base member for cooling the saturant solution in said reservoir above said base member.

* * * * *